US007448585B2

(12) United States Patent
Skiba

(10) Patent No.: US 7,448,585 B2
(45) Date of Patent: Nov. 11, 2008

(54) KEYBOARD SUPPORT ASSEMBLY

(75) Inventor: Tim Skiba, Osceola, WI (US)

(73) Assignee: Sunway, Incorporated, Centuria, WI (US)

( * ) Notice: Subject to any disclaimer, the term of this patent is extended or adjusted under 35 U.S.C. 154(b) by 0 days.

(21) Appl. No.: 11/305,664

(22) Filed: Dec. 16, 2005

(65) Prior Publication Data

US 2006/0226320 A1 Oct. 12, 2006

Related U.S. Application Data

(60) Provisional application No. 60/636,641, filed on Dec. 16, 2004.

(51) Int. Cl.
*E04G 3/00* (2006.01)

(52) U.S. Cl. ..... 248/286.1; 248/918; 361/680

(58) Field of Classification Search ..... 248/286.1, 248/274.1, 276.1, 281.11, 284.1, 291.1, 918; 108/105, 109; 361/680; 70/386, 182–186
See application file for complete search history.

(56) References Cited

U.S. PATENT DOCUMENTS

| | | | | |
|---|---|---|---|---|
| 4,616,798 | A | 10/1986 | Smeenge et al. | |
| 4,625,657 | A | 12/1986 | Little et al. | |
| 4,632,349 | A | 12/1986 | Anstey | |
| 4,706,919 | A | 11/1987 | Soberalski et al. | |
| 4,776,284 | A | 10/1988 | McIntosh | |
| 4,826,123 | A | 5/1989 | Hannah et al. | |
| 4,843,978 | A | 7/1989 | Schmidt et al. | |
| 5,037,054 | A | 8/1991 | McConnell | |
| D410,453 | S | 6/1999 | Timm | |
| 6,027,090 | A * | 2/2000 | Liu | 248/281.11 |
| 6,045,098 | A | 4/2000 | Timm | |
| 6,233,031 | B1 | 5/2001 | Ishitaka | |
| 6,257,538 | B1 * | 7/2001 | Pangborn et al. | 248/284.1 |
| 6,336,618 | B1 | 1/2002 | Barber | |
| 6,398,176 | B1 * | 6/2002 | Liu | 248/284.1 |
| 6,460,816 | B1 | 10/2002 | Barber | |
| 6,523,797 | B2 | 2/2003 | LeClair et al. | |
| 6,598,844 | B2 | 7/2003 | Barber | |
| 6,601,812 | B2 | 8/2003 | LeClair et al. | |
| 6,726,168 | B2 * | 4/2004 | Barber | 248/284.1 |
| 6,905,102 | B2 * | 6/2005 | Lin | 248/285.1 |
| 7,004,438 | B2 * | 2/2006 | Lin | 248/289.11 |
| 2004/0195482 | A1 * | 10/2004 | Kollar et al. | 248/282.1 |
| 2004/0262477 | A1 * | 12/2004 | Whitaker et al. | 248/284.1 |

* cited by examiner

*Primary Examiner*—Ramon O Ramirez
(74) *Attorney, Agent, or Firm*—Merchant & Gould P.C.; Charles E. Golla

(57) ABSTRACT

A keyboard support assembly that uses a cam system for locking and unlocking the position of the keyboard platform. The keyboard support assembly includes a support platform for supporting a keyboard, connected by a first arm and second arm to a desk mounting bracket, the first and second arms pivotal in relation to each other.

15 Claims, 10 Drawing Sheets

KEYBOARD SUPPORT ASSEMBLY

Priority under 35 U.S.C. § 119(e) is claimed to provisional application Ser. No. 60/636,641, filed on Dec. 16, 2004, and entitled "Keyboard Support Assembly". The complete disclosure of application 60/636,641 is incorporated by reference herein.

FIELD

This disclosure is directed to an adjustable support mechanism for mounting under a desktop, such as for supporting a computer keyboard or the like.

BACKGROUND

Various mechanisms for supporting computer keyboards below the desktop surface are known. Smeenge, in U.S. Pat. No. 4,616,798, entitled "Adjustable Support for CRT Keyboard", discloses a mechanism which includes first and second sets of parallel, equal length, articulating arms that link first and second brackets with a keyboard platform at one end and a sliding bracket plate attached beneath the desktop at the opposite end. The parallel arms are pivotally connected to the platform and bracket plate and move in a vertical plane to maintain the keyboard support platform in a generally horizontal position regardless of the position of the platform relative to the desktop. During storage of the keyboard support platform, the arms pivot so that the platform is then lowered to a retracted position below the level of the desktop. The arms may be locked in a fixed orientation by a threaded handle or lever which inhibits pivotal motion of one or both arms.

Other keyboard support constructions are illustrated in U.S. Pat. Nos. 4,625,657; 4,632,349; 4,706,919; 4,776,284; 4,826,123; and 4,843,978. Each of these described designs uses a parallel arm type mechanism that allows adjustment of the height of the keyboard support. U.S. Pat. Nos. 6,233,031; 6,523,797 and 6,601,812 also disclose designs with parallel arms that allow adjustment of the height of the keyboard support platform. McConnell, U.S. Pat. No. 5,037,054, entitled "Adjustable Support Mechanism for a Keyboard Platform", shows a keyboard support mechanism that uses non-parallel arms to support the keyboard platform.

These various prior art mechanisms are useful in conjunction with standard desk equipment.

Thus, there has developed a need for improved keyboard support mechanisms for storage of a computer keyboard and which permit easy movement of the platform to a desired level. Additionally, another desired characteristic for such mechanisms is to provide a stable surface for the keyboard. Further desired is an improved mechanism which safely and securely locks a keyboard platform in a desired orientation and which permits easy release or unlocking of the platform from a fixed orientation.

SUMMARY OF THE DISCLOSURE

The present disclosure is directed to a keyboard support assembly that uses a cam system for locking and unlocking the position of the keyboard platform. The keyboard support assembly includes a support platform for supporting a keyboard, connected by a first arm and second arm to a desk mounting bracket.

The first arm is fixedly and pivotally attached to the desk mounting bracket at a first end and also fixedly and pivotally attached to the keyboard platform at a second end opposite the first end. The second arm is slideably and pivotally attached to the desk mounting bracket at a first end and fixedly and pivotally attached to the keyboard platform at a second end and opposite the first end. At the desk mounting bracket, the arms are arranged so that the second arm is positioned between the first arm and the desk mounting bracket.

At the first end of each arm, which is proximate the desk mounting bracket, an axis extends from the desk mounting bracket, through an elongate slot (e.g., an arcuate elongate slot) in the second arm and through a slot or aperture in the first arm. The elongate slot in the second arm is sufficiently long to permit slideable movement of the axis therein. The slot or aperture in the first arm is shaped and size to allow pivoting of the first arm around the axis. Attached to the first arm proximate the slot or aperture is a cam member having an arcuate shaped surface. The arcuate shaped surface is generally on the internal side of the first arm. When two cam members are present on the first arm, the two arcuate shaped surfaces face one another. The slot or aperture in the first arm is preferably aligned with a slot or aperture that passes through the cam member.

A locking system, which is activated by pivotal actuation of or downward force on the keyboard platform, is provided so that upon application of a downward force to the keyboard support platform, the first and second arms lock into a fixed position or orientation and maintained in that position until released. Removal of the force releases the locking system, permitting arm movement and platform reorientation. The locking system includes the cam surface and a roller bearing that acts as a cam follower along the cam surface. Engagement of the roller bearing against the cam surface urges the first arm against the second arm and locks the second arm between the first arm and the desk mounting bracket, upon application of downward force on the platform. The roller bearing is preferably attached to or aligned with the axis that passes through the first arm and the second arm.

In a first specific aspect, the invention includes a support assembly that has a bracket member for attachment to an underside of a work support and a support platform, such as for attachment to the keyboard. A first arm with opposite ends is pivotally connected to the bracket member and to the support platform, and a second arm with a first end and a second end is slideably connected to the bracket member at its first end and pivotally connected to the support platform at its second end. A first pivotal connection of the first arm to the bracket member includes a cam member having an arcuate surface and a roller bearing for engaging the arcuate surface, the cam member being affixed to the first arm. There is a slideable connection of the second arm to the bracket member, a second pivotal connection of the second arm to the bracket member, a third pivotal connection of the first arm to the support platform, and a fourth pivotal connection of the second arm to the support platform. Each of the first, second, third and fourth pivotal connections is different, but the first pivotal connection and the slideable connection are the same.

In a second specific aspect, the invention includes a method of locking a support assembly in a position, the method including contacting a cam member having an arcuate surface with a roller bearing, the cam member connected to a first arm on the side opposite the arcuate surface, and urging the cam member in the direction of the first arm against a second arm and a bracket member in order to decrease the distance between the first arm and the bracket member and thus lock the second arm in relation to the first arm.

Other features of the keyboard support assembly are provided below.

BRIEF DESCRIPTION OF THE DRAWING

In the Detailed Description which follows, reference will be made to the drawing comprised of the following Figures.

DESCRIPTION OF A PREFERRED EMBODIMENT

Figure 1:
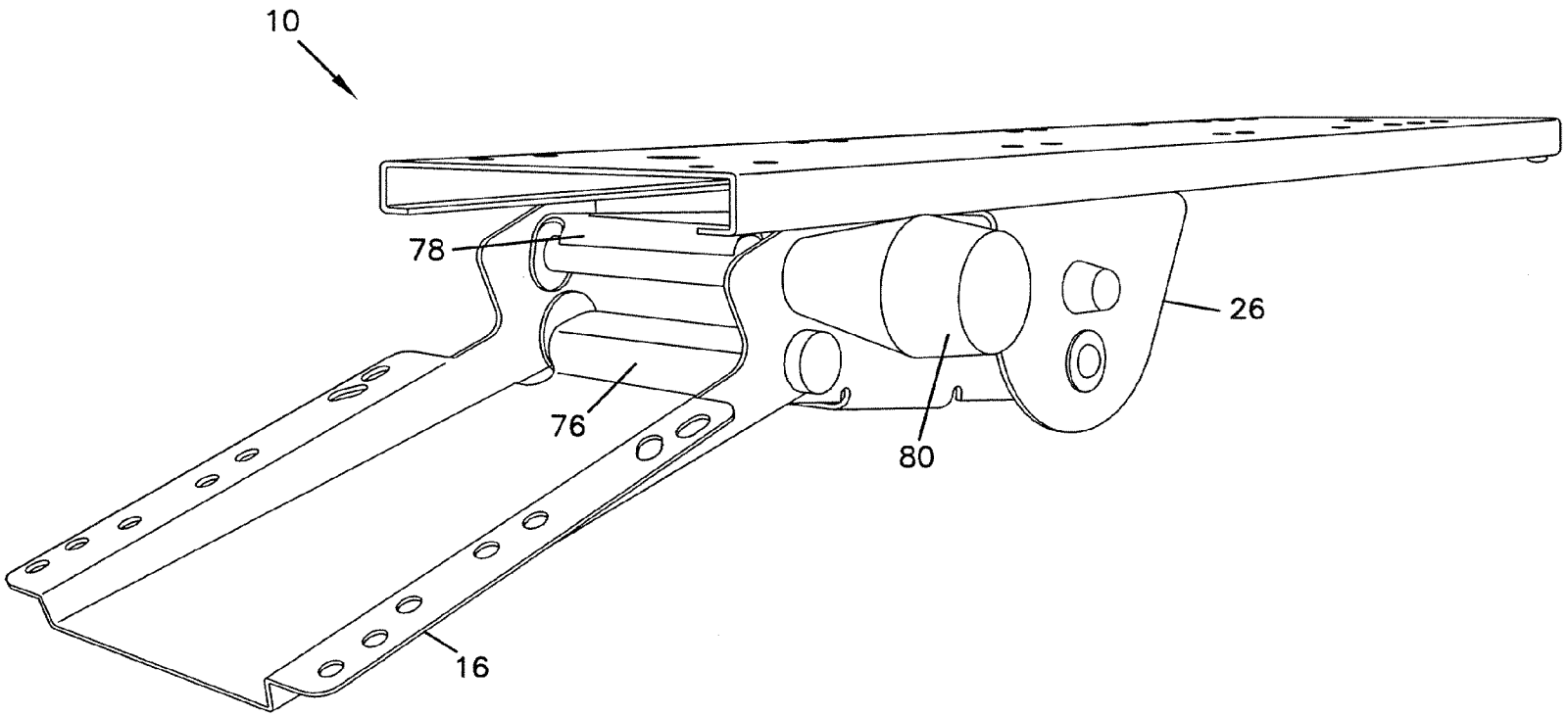
FIG. 1 is a perspective view of a keyboard support assembly according to the present disclosure, positioned as it would be when attached to the underside of a work surface such as a desk.
Figure 6:
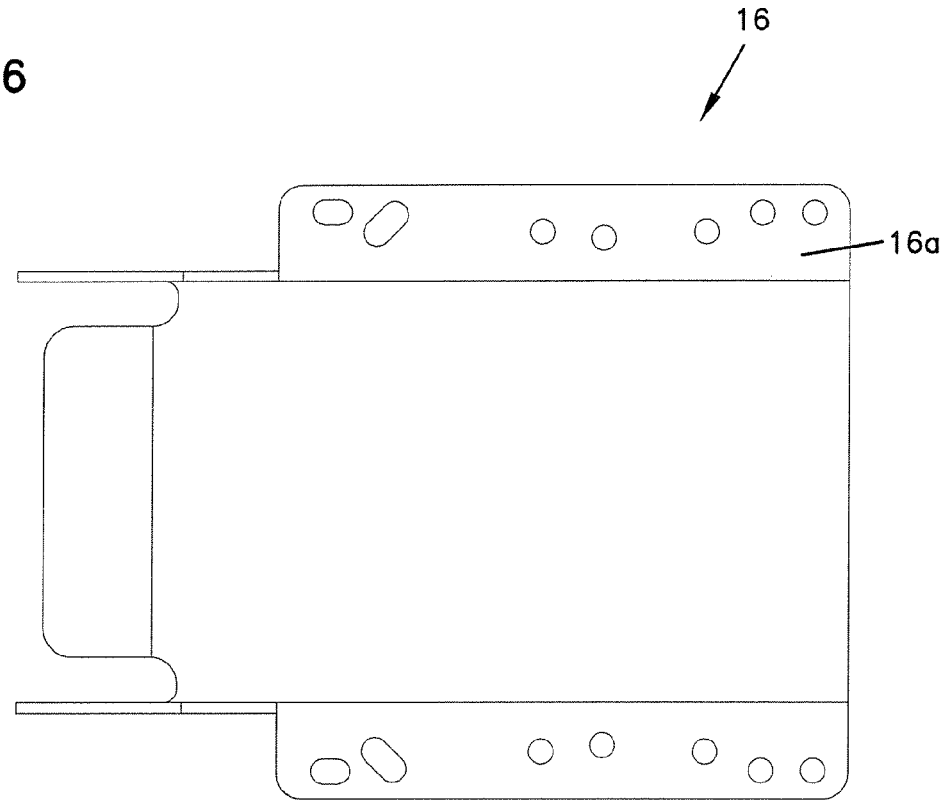
FIG. 6 is a top plan view of the support member of FIG. 5.
Figure 18:
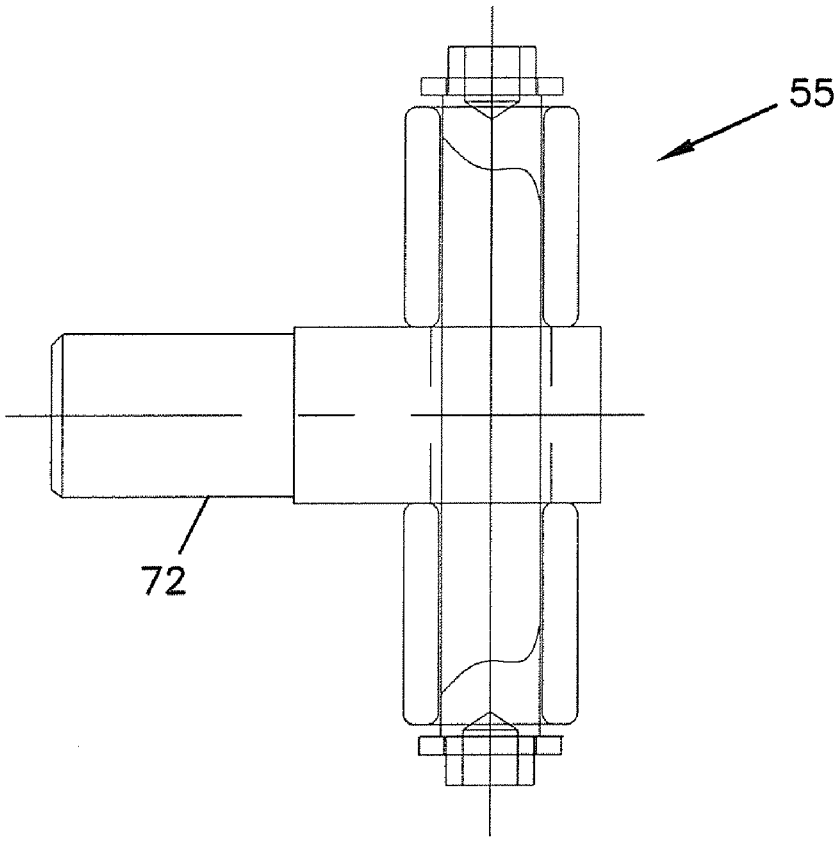
FIG. 18 is a side plan view of a roller bearing.

Referring to the figures, wherein like numerals represent like parts throughout the several views, there is shown in FIG. 1 a keyboard support assembly 10 in conjunction with a surface, such as a desk underside. FIG. 2 through FIG. 5 are additional views of keyboard support assembly 10 on desk underside 20, and FIG. 6 though FIG. 18 are line drawings of various elements of keyboard support assembly 10.

Support assembly 10 has a first end that attaches to desk underside 20 and an opposite second end for supporting an item, such as a computer keyboard. Present at the second end is a support member 16, generally configured for supporting a keyboard, either directly or indirectly on its surface 16*a* (see FIGS. 5 and 6).

In typical use of support assembly 10, the second end with support member 16 is extended out from under desk underside 20 to provide access to the keyboard or other peripheral equipment supported thereon. When not in use, the second end with support member 16 is pushed back under desk underside 20 for storage.

Support assembly 10 attaches to desk underside 20 at the first end. In this illustrated embodiment, fixedly connected to desk underside 20 is track 22, in which is slideably positioned member 24. Track 22 can be any suitable design, and in the illustrated embodiment, is a wide channel having unshaped channels longitudinally extending along the edges to slideably receive member 24. Member 24 allows a portion of support assembly 10 (in particular, the second end and support member 16) to move out from under and back under desk underside 20.

Figure 13:
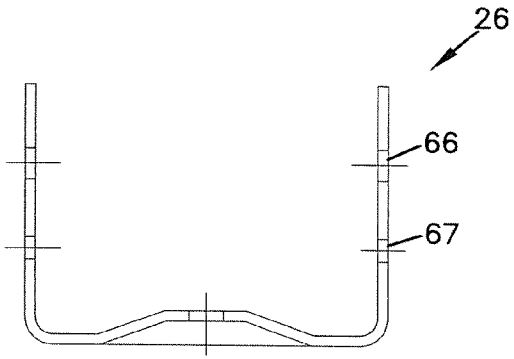
FIG. 13 is an end view of the bracket of FIG. 12.
Figure 12:
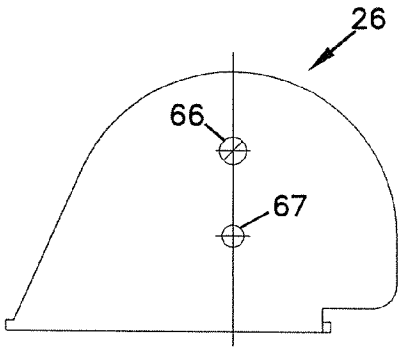
FIG. 12 is a side plan view of a bracket.
Figure 14:
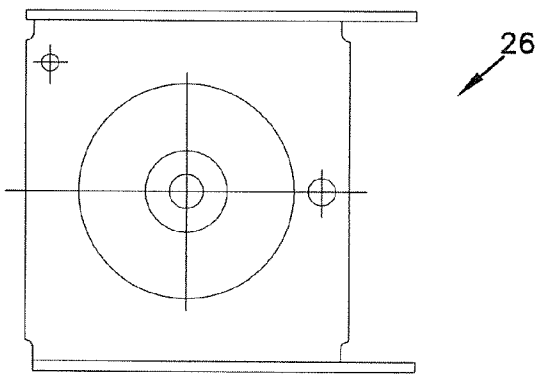
FIG. 14 is a top plan view of the bracket of FIGS. 12 and 13.
Figure 16:
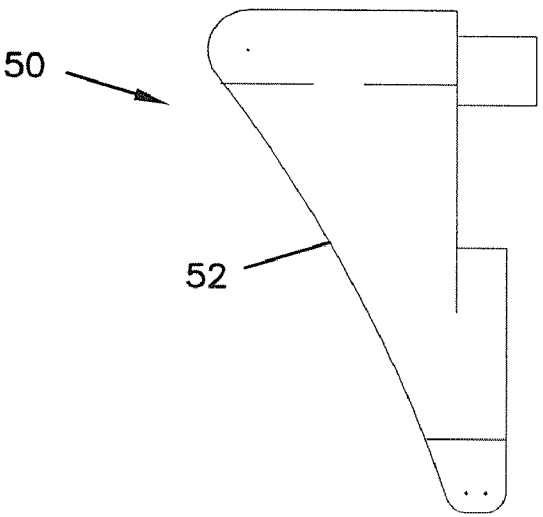
FIG. 16 is a top plan view of the cam member of FIG. 15.
Figure 15:
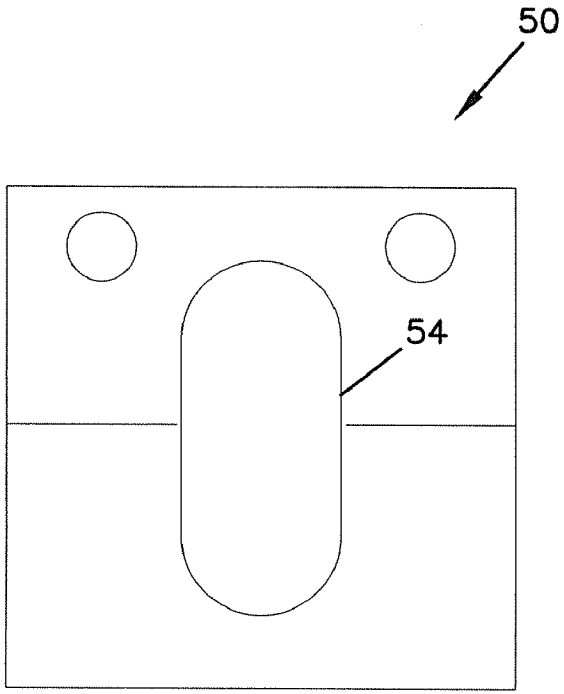
FIG. 15 is a front plan view of a cam member.

Pivotally connected to member 24 may be a bracket 26. Bracket 26 may rotationally pivot in relation to member 24 and track 22. Bracket 26 allows the second end of assembly 10, with support member 16, to pivot laterally or transversely in relation to the user. It is understood that in alternate embodiments, member 24 and bracket 26 may be a single element, or bracket 26 may not pivot in relation to member 24. For the continued discussion below, assembly 10 will be described as having a separate bracket 26 from member 24, although, it some embodiments, bracket 26 or a variation thereof may be slideably mounted to track 22 or even to desk underside 20. Bracket 26 is illustrated in various views in FIGS. 12 through 14. In the embodiment illustrated, bracket 26 is a generally U-shaped member, as best seen in FIG. 13. Additional discussion of bracket 26 is provided below.

Returning to FIGS. 2 through 4, extending between bracket 26 and support member 16 is a pair of linkage arms, first arm 30 and second arm 40. Arms 30, 40 extend generally together from bracket 26 to member 16, with portions of first arm 30 positioned slightly internal to second arm 40, as will be described below. First arm 30 is illustrated in FIGS. 7 and 8 and second arm 40 is illustrated in FIGS. 9 through 11.

Each of arms 30, 40 is an elongate structure, in general as a U-shaped construction, with a first side (designated as A in FIGS. 8 and 10) and an opposite second side (designated as B in FIGS. 8 and 10); sides A and B are preferably mirror images of each other. The following description of various features is understood to apply to both sides of each arm 30, 40. That is, even though the following description literally describes one specific feature, it is to be understood that a second of that specific feature can be present as a mirror image on the other side of arm 30 or 40. In the embodiment illustrated, both arms 30, 40 have sides that are mirror images.

Figure 7:
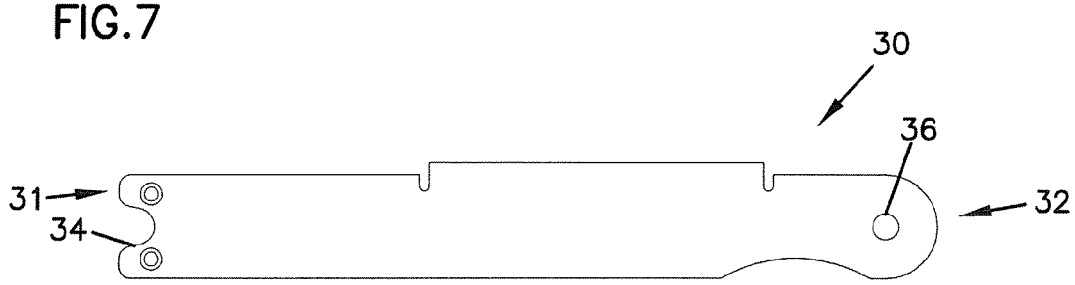
FIG. 7 is a side plan view of a first linkage arm.
Figure 8:
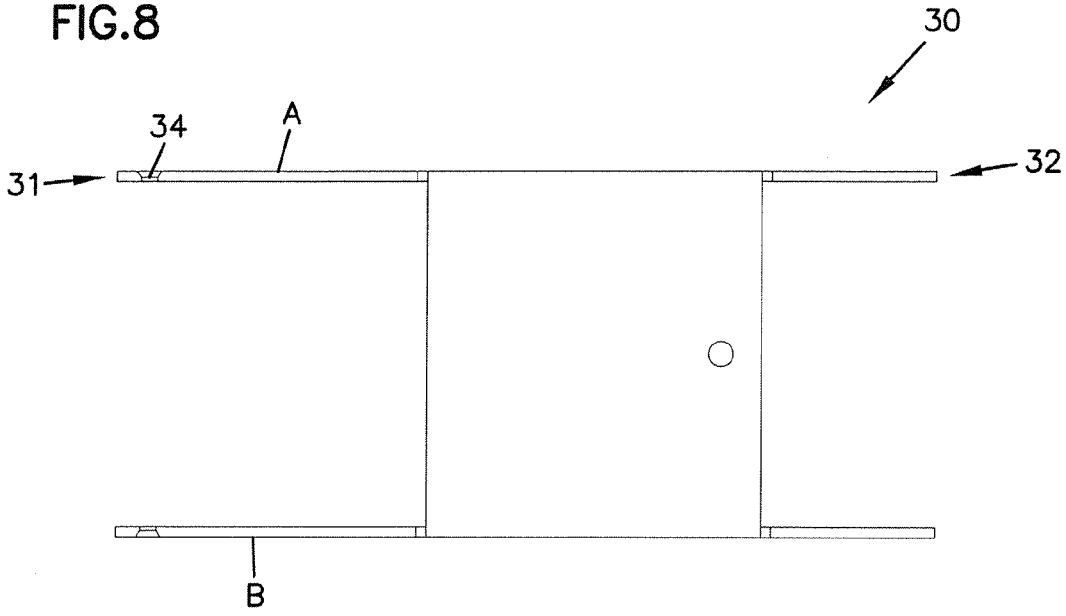
FIG. 8 is a top plan view of the first arm of FIG. 7.
Figure 17:
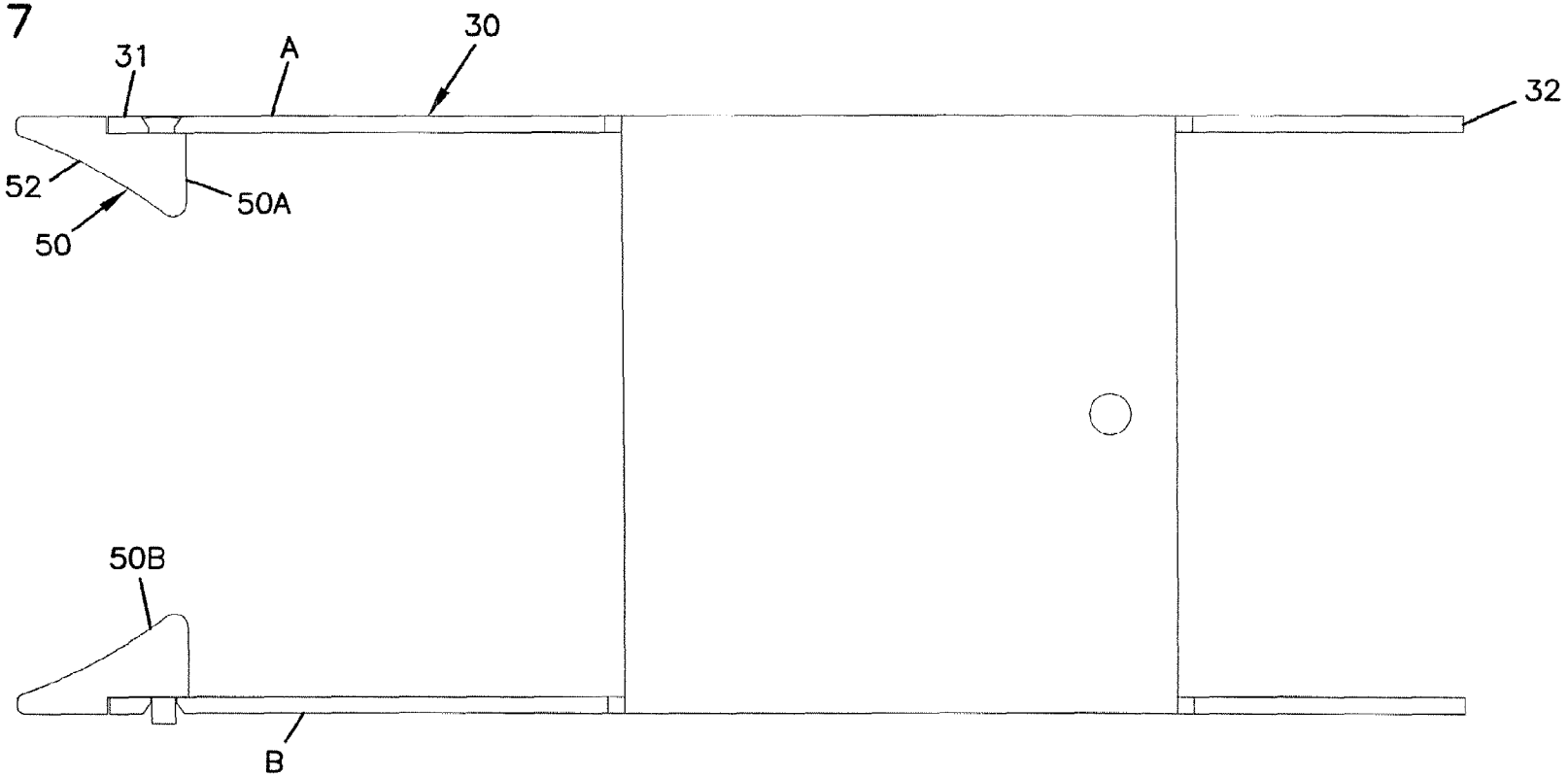
FIG. 17 is a top plan view illustrating the cam member positioned on the first linkage arm.

Referring to FIGS. 7 and 8, first arm 30 has a first end 31 and an opposite second end 32. First end 31 includes an indent 34, such as a concave feature, and second end 32 includes a hole 36, the features of which are described below. In assembly 10, first end 31 is proximate bracket 26 and second end 32 is proximate member 16. First arm 30, at first end 31, includes a cam member 50 attached thereto (see FIGS. 3-4 and 17), which is further described below. (As shown in FIG. 17, first arm 30 has a first cam member 50A present on the first side A of arm 30 and a second cam member 50B present on the second side B of arm 30. This is what was meant by the proceeding discussion that although only one specific element may be discussed, two such elements are present.)

Figure 9:
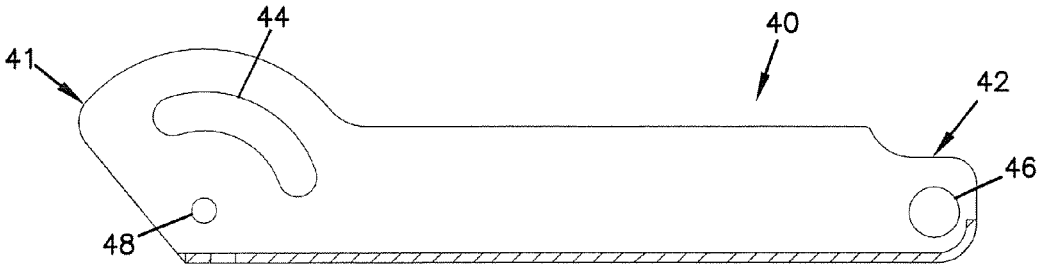
FIG. 9 is a side plan view of a second linkage arm.
Figure 10:
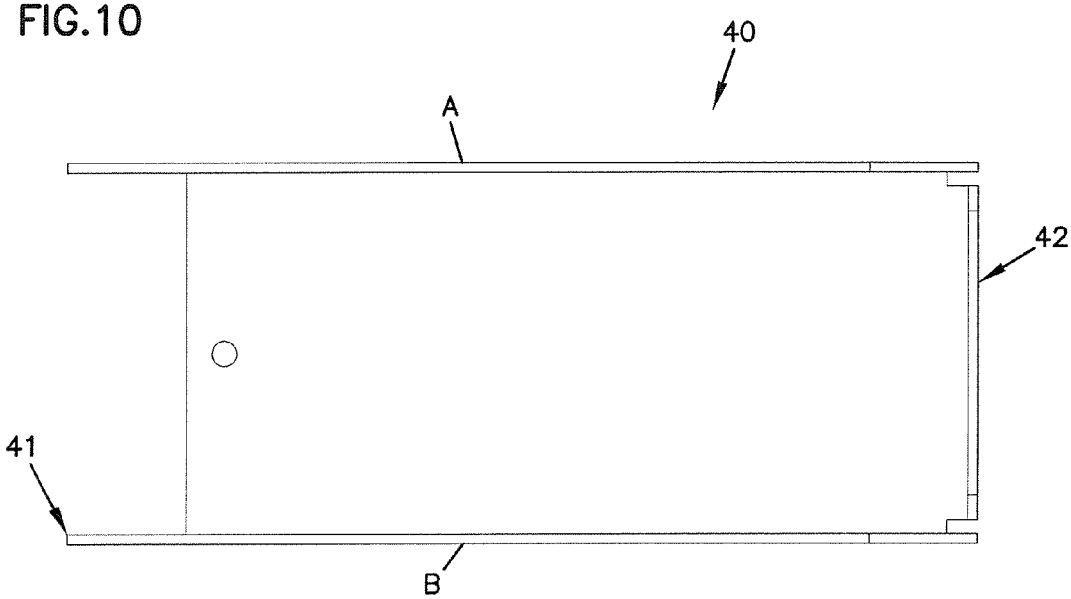
FIG. 10 is a top plan view of the second arm of FIG. 9.
Figure 11:
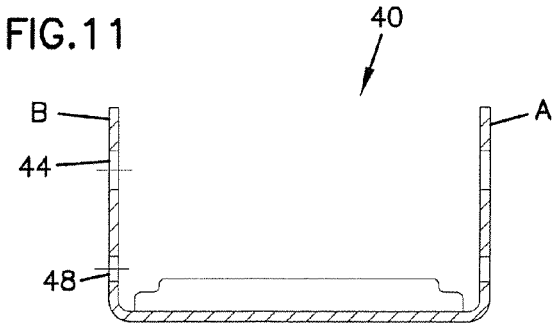
FIG. 11 is an end cross-sectional view of the second arm of FIGS. 9 and 10.

Referring to FIGS. 9 through 11, second arm 40 is shown with a first end 41 having slot 44, which is preferably an arcuate slot, and hole 48 therethrough, and a second end 42 having a hole 46 therethrough, the features of which are described below. In assembly 10, first end 41 is proximate bracket 26 and second end 42 is proximate support member 16. FIGS. 10 and 11 show second arm 40 having a general U-shape and side A and side B.

Figure 2:
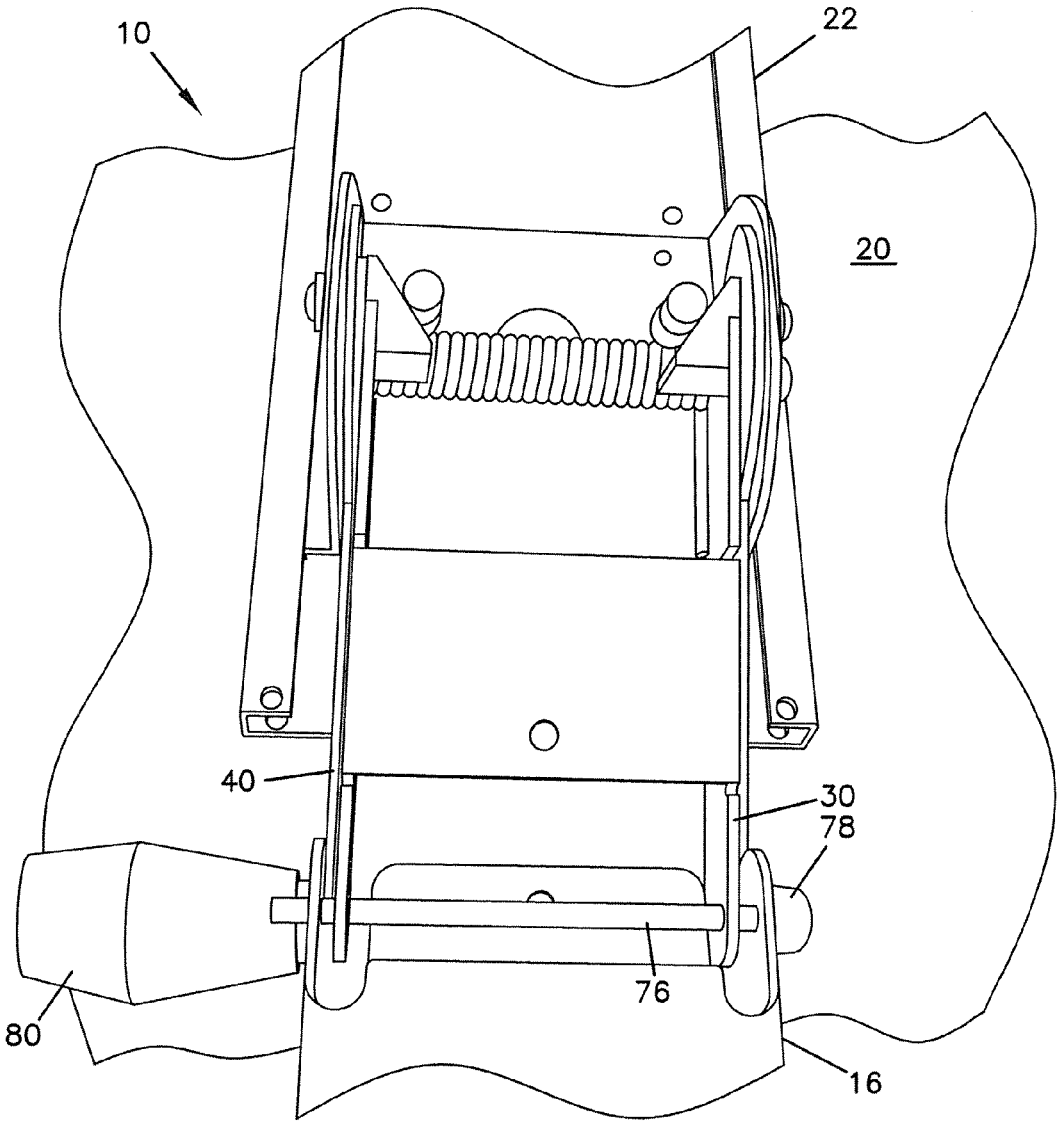
FIG. 2 is a perspective bottom view of a portion of the keyboard support assembly, showing a track, locking system, and various other features of the assembly.
Figure 3:
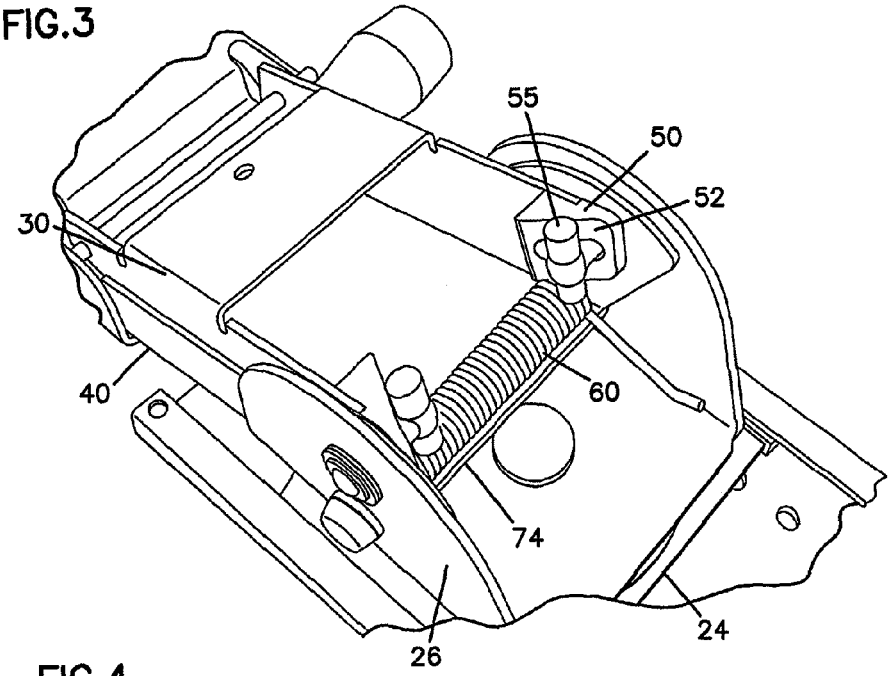
FIG. 3 is perspective side and bottom view of a portion of the keyboard support assembly, focused on the locking system.
Figure 4:
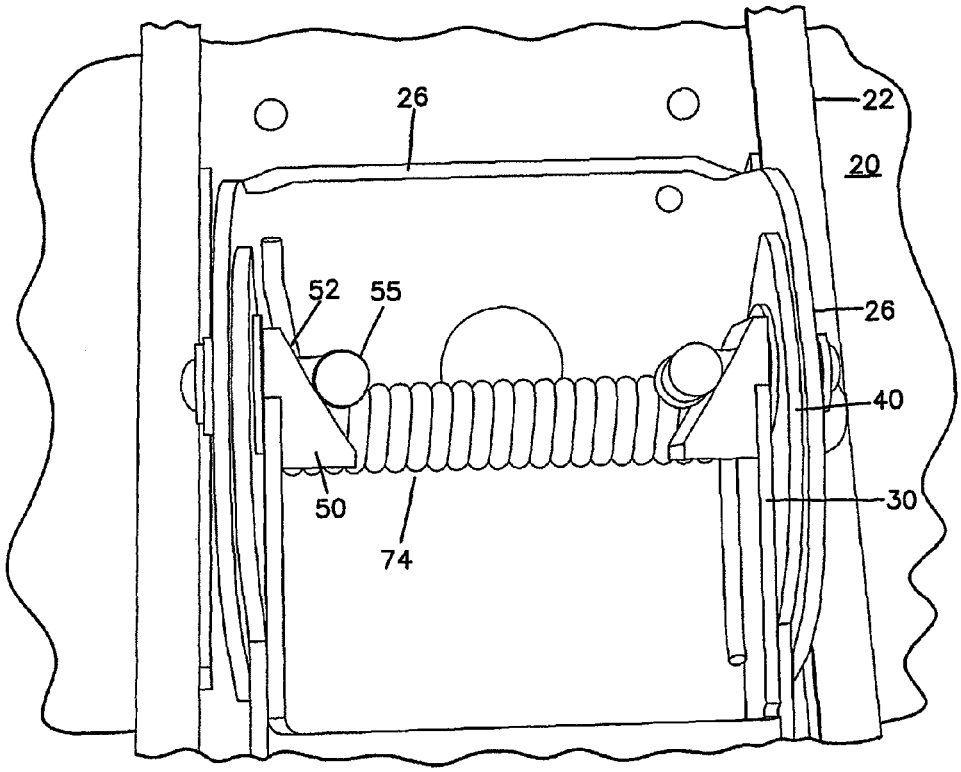
FIG. 4 is a bottom view of a portion of the keyboard support assembly, focused on the locking system.
Figure 5:
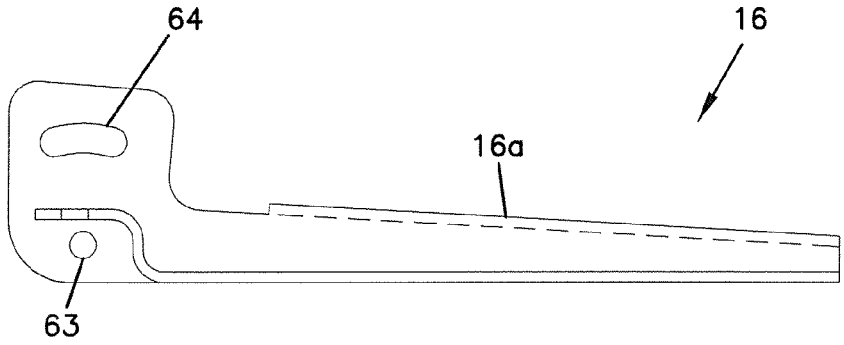
FIG. 5 is a side plan view of a support member for supporting a keyboard.

Arms 30, 40 are moveably connected together and to member 16 and bracket 26 in the following manner:

A pin 72 (see FIG. 18) extends past indent 34 of first arm 30 and through slot 44 of second arm 40 and connects to bracket 26 via hole 66 (see any of FIGS. 2, 3 and 4 for the general configuration). Cam member 50, which is also connected to bracket 26 via hole 66, has an arcuate surface 52 with hole 54 therethrough. Cam 50 is positioned on first arm 30 so that hole 54 aligns with indent 34. Positioned on pin 72 is a roller bearing 55 that engages and preferably rolls along arcuate surface 52. In this embodiment, pin 72 does not extend across first arm 30 from side A to side B; rather, a separated pin 72 is present at each side A, B.

A bar 74 extends through aperture 48 in second arm 40 and connects to bracket 26 via hole 67. A tension mechanism 60, such as a spring, is positioned with or on bar 74. In this embodiment, bar 74 and tension mechanism 60 extend across second arm 40 from first side A to second side B.

A rod 76 (see FIG. 2) extends through hole 36 of first arm 30 and connects to member 16 at hole 63. In this embodiment, rod 76 extends across first arm 30 from first side A to second side B. Rod 76 is also visible in FIG. 1.

A rod 78 (see FIG. 2) extends through aperture 46 in second arm 40 and connects to member 16 at slot 64. In this embodiment, rod 78 extends across second arm 40 from first side A to second side B, and includes a handle 80 for facilitating movement of support member 16. Rod 78 is not well visible in this view, as it is positioned under a portion of member 16, however, the ends of rod 78 and handle 80 are visible. Rod 78 is visible in FIG. 1.

Although the terms "rod", "bar", "pin" and the like have been used, it is understood that any type of suitable mechanical attachment mechanism could be used.

Although bar 74, rod 76 and rod 78 extend across the respective arm 30 and/or arm 40, it is understood that any or all of these could be a two-part structure, such as a separated mechanism, such as pin 72.

Because of the configuration and interaction of the various elements, first arm 30 is fixedly and pivotally attached to desk mounting bracket 26 and also fixedly and pivotally attached to platform member 16. Second arm 40 is slideably and pivotally attached to desk mounting bracket 26 and fixedly and pivotally attached to platform member 16. First arm 30 has a width that, at least is some regions, is less than the width of second arm 40, thus allowing first arm 30 to be at least partially nested in second arm 40. See FIGS. 2 and 3.

At the end of assembly 10 connected to desk underside 20, pin 72 extends from mounting bracket 26, through slot 44 in second arm 40 and past indent 34 of first arm 30 and through aperture 54 in cam 50. Slot 44 is sufficiently long to permit slideable movement of pin 72 therein. Indent 34 is shaped and sized to permit pivoting of first arm 30 around pin 72. Aperture 54 is likewise shaped and sized to permit pivoting of first arm 30 around pin 72.

Cam member 50 with arcuate surface 52 and roller bearing 55, which contacts arcuate surface 52, form a locking system. This locking system is activated by pivotal actuation of or downward force on platform 16, so that upon application of a downward force to platform 16, arms 30, 40 are locked into a fixed position or orientation and maintained in that position. Removal of the force releases the locking system permitting arm 30, 40 movement and platform reorientation.

In detail, upon movement of member 16 in relation to bracket 26, first arm 30 pivots via hole 36 in respect to member 16 about rod 76 and pivots about pin 72 via indent 34 in respect to bracket 26. Second arm 40 pivots about rod 78 via aperture 46 in respect to member 16 and about bar 74 via aperture 48 in respect to bracket 26. Second arm 40 also slideably and pivotally moves in respect to bracket 26 via pin 72 through slot 44. Upon this movement, roller bearing 55 contacts arcuate surface 52 of cam member 50, urging cam member 50 and first arm 30 against second arm 40 and bracket 26, thus decreasing the space between arms 30 and 40 and tightening the parts together.

The various elements of support assembly 10 can be made from any material suitable, and should be able to withstand the conditions of use. For example, the material should be sufficiently tough to withstand the recurring friction present between sliding and pivoting parts. Wear should be minimal, as this will decrease the useful life of support assembly 10. Arms 30, 40 should be sufficiently strong and rigid to support member 16 and any items thereon, such as a keyboard, without appreciable dropping or sagging when support member 16 is extended away from the mounting surface. Suitable materials include metals (such as steel, stainless steel, and aluminum), plastics (such as polyethylene, polypropylene, ABS, and polycarbonate), and composites (such as carbon fiber reinforced plastics).

It is to be understood, however, that even though numerous characteristics and advantages of the present disclosure have been set forth in the foregoing description, together with details of the structure and function of the disclosure, such disclosure is illustrative only, and is not intended to be limiting to the scope of the disclosure in any manner. The keyboard support assembly or its various parts are not to be limited to the described embodiments, or to the use of specific components, configurations or materials that might be described herein. All alternative modifications and variations of the present assembly are covered.

What is claimed is:

1. A support assembly comprising:

a. a bracket member configured to attach to an underside surface;

b. a support platform;

c. a first arm having a first end and an opposite second end, the first end pivotally connected to the bracket member and the second end pivotally connected to the support platform;

d. a second arm having a first end and an opposite second end, the first end slideably connected to the bracket member and the second end pivotally connected to the support platform;

e. a cam member attached to said first arm adjacent its first end and pivotally connected to the bracket member;

f. a roller bearing operatively mounted to said bracket member and configured to cooperatively engage said cam member; and g. wherein said roller bearing selectively applies pressure through said cam member to said first ends of the first and second arms to selectively lock and release movement of the first ends relative to the bracket member.

2. The support assembly of claim 1, wherein the cam member has an arcuate surface and the roller bearing engages the arcuate surface.

3. The support assembly of claim 1, wherein the first arm has a first half and a second half, that are mirror images of each other, and the second arm has a first half and a second half, that are mirror images of each other.

4. The support assembly of claim 3, wherein said cam member comprises a first cam member and said roller bearing comprises a first roller bearing, further comprising a second cam member and a second roller bearing mounted to cooperatively engage the second cam member, the second cam member being secured to the first arm at its first end and pivotally connected to the bracket member.

5. The support assembly of claim 4, wherein the first cam member has a first arcuate surface and the first roller bearing engages the first arcuate surface and the second cam member has a second arcuate surface and the second roller bearing engages the second arcuate surface.

6. The support assembly of claim 1, wherein the second arm, adjacent its first end, includes an arcuate slot configured to slideably and pivotally mount said second arm to the bracket and the first arm.

7. The support assembly of claim 6, wherein the second arm, adjacent its first end, further includes a hole for pivotal connection to the bracket member.

8. The support assembly of claim 1, wherein the second arm is a U-shaped member and wherein at least a portion of the first end of the second arm operatively lies between the first end of the first arm and the bracket member.

9. A method of locking a support assembly in a position relative to a mounting bracket moveably disposed relative to said support assembly, the method comprising:

a. contacting a cam member having an arcuate surface with a roller bearing, the cam member being connected to a first arm of the support assembly on a side of the cam member opposite the arcuate surface; and b. urging the cam member in the direction of the first arm toward a second arm of the support assembly and the bracket member in order to decrease the distance between the first arm and the bracket member and thus lock the second arm in relation to the first arm.

10. The method of claim 9, wherein urging the cam member in the direction of the first arm against a second arm and a bracket member comprises:

pivoting the first arm in relation to the bracket member and slideably moving the second arm in relation to the bracket member.

11. The method of claim 10, wherein pivoting the first arm in relation to the bracket member and slideably moving the second arm in relation to the bracket member comprises:

pivoting a first end of the first arm in relation to the bracket member and slideably moving a first end of the second arm in relation to the bracket member.

12. The method of claim 11, further comprising:

a. pivoting a second end of the first arm in relation to a support platform; and b. pivoting a second end of the second arm in relation to the support platform.

13. A method of selectively locking the position of a support assembly relative to a mounting bracket, using a cam member with an arcuate cam bearing surface, comprising the steps of:

a. arranging the cam member to move the support assembly toward engagement with the mounting bracket;

b. engaging the arcuate cam bearing surface with a roller bearing; and c. moving the roller bearing along said arcuate cam bearing surface to move said support assembly into frictional locking engagement with said mounting bracket.

14. The method of claim 13, further including the steps of:

a. providing the support assembly with first and second support arms operatively connected for pivotal and sliding movement relative to one another;

b. operatively connecting said cam member to a first of said support arms; and c. wherein the step of moving said roller bearing comprises moving said roller bearing along said cam surface to sandwich said second support bracket in frictional locking engagement between said first support arm and said mounting bracket.

15. The method of claim 13, wherein the step of moving the roller bearing along said arcuate cam bearing surface comprises moving said support assembly into said locking engagement with said mounting bracket at an increasingly non-linear rate.

* * * * *